United States Patent [19]

Martorano

[11] 4,096,981

[45] Jun. 27, 1978

[54] APPARATUS FOR STRIPPING A CONTINUOUS WEB OF MATERIAL FROM THE MARGINAL EDGE OF A BODY

[75] Inventor: Sam Martorano, Des Plaines, Ill.

[73] Assignee: Wilson Jones Company, Chicago, Ill.

[21] Appl. No.: 779,002

[22] Filed: Mar. 18, 1977

[51] Int. Cl.[2] ..... B26F 3/02

[52] U.S. Cl. ..... 225/99; 93/36 A

[58] Field of Search ..... 225/99, 4; 93/36 A, 93/58

[56] References Cited

U.S. PATENT DOCUMENTS

| | | | |
|---|---|---|---|
| 2,508,083 | 5/1950 | Winkler | 225/99 X |
| 2,588,384 | 3/1952 | Hedstrom et al. | 93/58 R |
| 2,765,205 | 10/1956 | Capella et al. | 225/99 X |
| 2,789,640 | 4/1957 | Balden | 225/99 X |
| 3,204,841 | 9/1965 | Guyer | 225/99 X |
| 3,235,149 | 2/1966 | Armstrong, Jr. et al. | 225/99 X |
| 3,807,610 | 4/1974 | Mueller, Jr. | 93/36 A |
| 3,889,863 | 6/1975 | Deslauriers | 225/99 |

*Primary Examiner*—J. M. Meister

*Attorney, Agent, or Firm*—Pennie & Edmonds

[57] ABSTRACT

An apparatus for use in stripping a continuous web of severable material from at least along a portion of the marginal edge of a body comprising supporting means having a receiving surface upon which the body with the continuous web is advanced along a predetermined path. The apparatus embodies deflecting means pivotally connected to the supporting means for assisting in directing the leading edge of the advanced continuous web vertically so as to facilitate a stripping thereof while permitting travel of the body along the path. Stripping means including a pair of generally longitudinal and cooperating rollers are contemplated as being connected to the supporting means and positioned along the path for grabbing therebetween the vertically deflected continuous web and stripping it from the body in response to the advancement of the body along the path. Also, envisioned are advancing means operatively connected to the supporting means remote from the stripping means for automatically continuing the advancement of the body by pulling the body past the rollers along the path for ensuring complete tearing apart of the web from the marginal edge.

3 Claims, 5 Drawing Figures

APPARATUS FOR STRIPPING A CONTINUOUS WEB OF MATERIAL FROM THE MARGINAL EDGE OF A BODY

BACKGROUND OF THE INVENTION

1. Field of the Invention

This particular invention, in general, pertains to a method and an apparatus for carrying out the method in which a continuous strip or web of waste material is severed or detached from along a marginal edge of a body. More specifically, it is directed to a novel and improved apparatus and method which simply and continuously severs the tear seal trim from the peripheral margin of a vinyl type case for loose-leaf books or the like.

2. Description of the Prior Art

It is conventional industrial practice in the manufacture of loose-leaf books or the like to use a vinyl type material for encasing chipboard jacket portions and the like. In the usual practice, the opposing and overlapping layers of the vinyl material are heat sealed together along the peripheral margin of the vinyl encased member. As a result of such process, an undesirable tear seal trim is formed which is ordinarily stripped or severed from the encased member. It should be understood that the tear seal trim material is usually considered that portion of the vinyl material which extends beyond a heat sealed and weakened edge portion along the marginal edge of the vinyl case.

A traditional technique employed in this field is to strip the tear seal trim from a vinyl covered case through the utilization of manual labor. It is easily recognized, of course, that through the employment of manual labor, the overall stripping operation of the vinyl tear seal from along the margin of the case is a rather time consuming process. In addition, of course, manual labor results in the overall operation costs being less satisfactory than would otherwise be commercially desired. Since the profit margin generally associated with the successful manufacture of vinyl covered cases for loose-leaf books is relatively small, it is believed to be rather evident that even small savings in production costs will result in significant commercial advantages.

Although several heretofore known prior art mechanisms exist which serve to sever or detach a strip or web of waste material from along the margin of a body they are, in general, characterized by complicated and relatively cumbersome structures. Often, special apparatus is ordinarily involved for conveying the articles which are to be cut and frequently a rather tediously achieved accurate alignment of cutting blades is necessary to detach the waste material. Exemplary of this general category of known stripping mechanisms are U.S. Pat. Nos. 2,508,683; 2,798,640; 3,204,841 and 3,889,863.

As a result of the foregoing considerations, it is clear that the known prior art approaches heretofore utilized for purposes of severing or detaching waste material from formed objects are less than satisfactory since, in general, they are more expensive and complicated than would otherwise be desired; particularly in those applications wherein tear seal trim is to be detached from the heat sealed vinyl marginal edge portion of the vinyl cases usually utilized in the formation of loose-leaf books and the like.

SUMMARY OF THE INVENTION

It is, therefore, an object of the present invention to overcome several of the aforementioned shortcomings generally associated with prior art approaches for stripping waste material from along the marginal edge of a body.

Broadly, in accordance with the principles of the present invention, there is provided an apparatus for use in stripping a continuous web of severable material from at least along a portion of the marginal edge of a body. In essential respects, such severing apparatus comprises supporting means defining a receiving surface upon which the body with the continuous web is advanced along a predetermined path. The apparatus embodies deflecting means pivotally connected to the supporting means for assisting in directing the leading edge of the advancing continuous web vertically so as to facilitate a stripping thereof while permitting travel of the body along the path. Stripping means including a pair of generally longitudinal and cooperating rollers are contemplated as being connected to the supporting means and positioned along the path for grabbing therebetween the vertically deflected continuous web and stripping it from the body in response to the advancement of the body along the path. Also, envisioned is advancing means operatively connected to the supporting means remote from the stripping means for automatically continuing the advancement of the body by pulling the body past the roller along the path for ensuring complete tearing apart of the web from the marginal edge.

The method envisaged as being within the spirit and scope of the instant invention enables the continuous web to be severed from at least along a portion of the marginal edge of the body. Basically, the method comprises the steps of feeding the body in a first direction along a predetermined path, vertically deflecting the leading edge of the advancing web so as to facilitate a stripping thereof, stripping the deflected continuous web by cooperating rollers as the body continues to advance in the first direction such that increasing portions of the web become gradually separated from the body by the rollers and automatically continuing advancement of the body along the predetermined path by pulling the body past the rollers such that complete severance of the web from the marginal edge of the body is accomplished.

BRIEF DESCRIPTION OF THE DRAWINGS

The above objects, features and advantages of the present invention will become readily apparent upon reading a detailed description of the present invention when viewed in conjunction with the accompanying drawings wherein like reference numerals indicate like structure throughout the several views.

DETAILED DESCRIPTION

Figure 1:
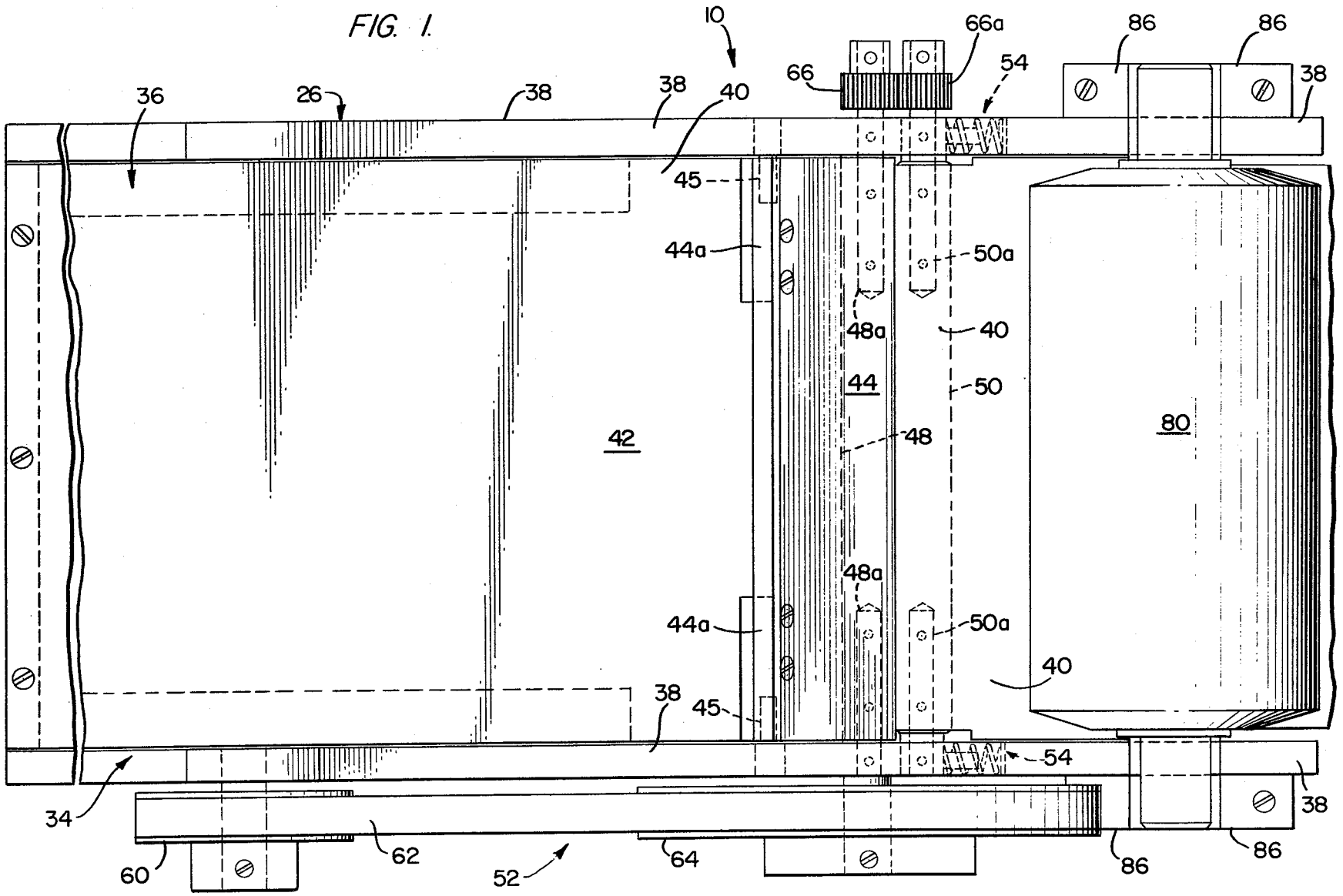
FIG. 1 represents a plan view of a tear seal stripping apparatus made in accordance with the principles of the present invention.

Referring now to the drawings, there is illustrated a novel and improved severing apparatus made in accordance with the principles of this invention and which is designated generally by reference number 10. Broadly, the severing apparatus 10 is particularly adapted for use in severing a continuous web of severable waste material from along the marginal edges of a body member. As will be described more clearly in the succeeding description, the particular severing apparatus 10 of the illustrated embodiment is especially adapted to continuously strip or separate a continuous web of a tear seal trim material 12 from along the marginal edges 14 of a vinyl covered case 16 of the type usually employed in the formation of loose-leaf books and the like.

Figure 2:
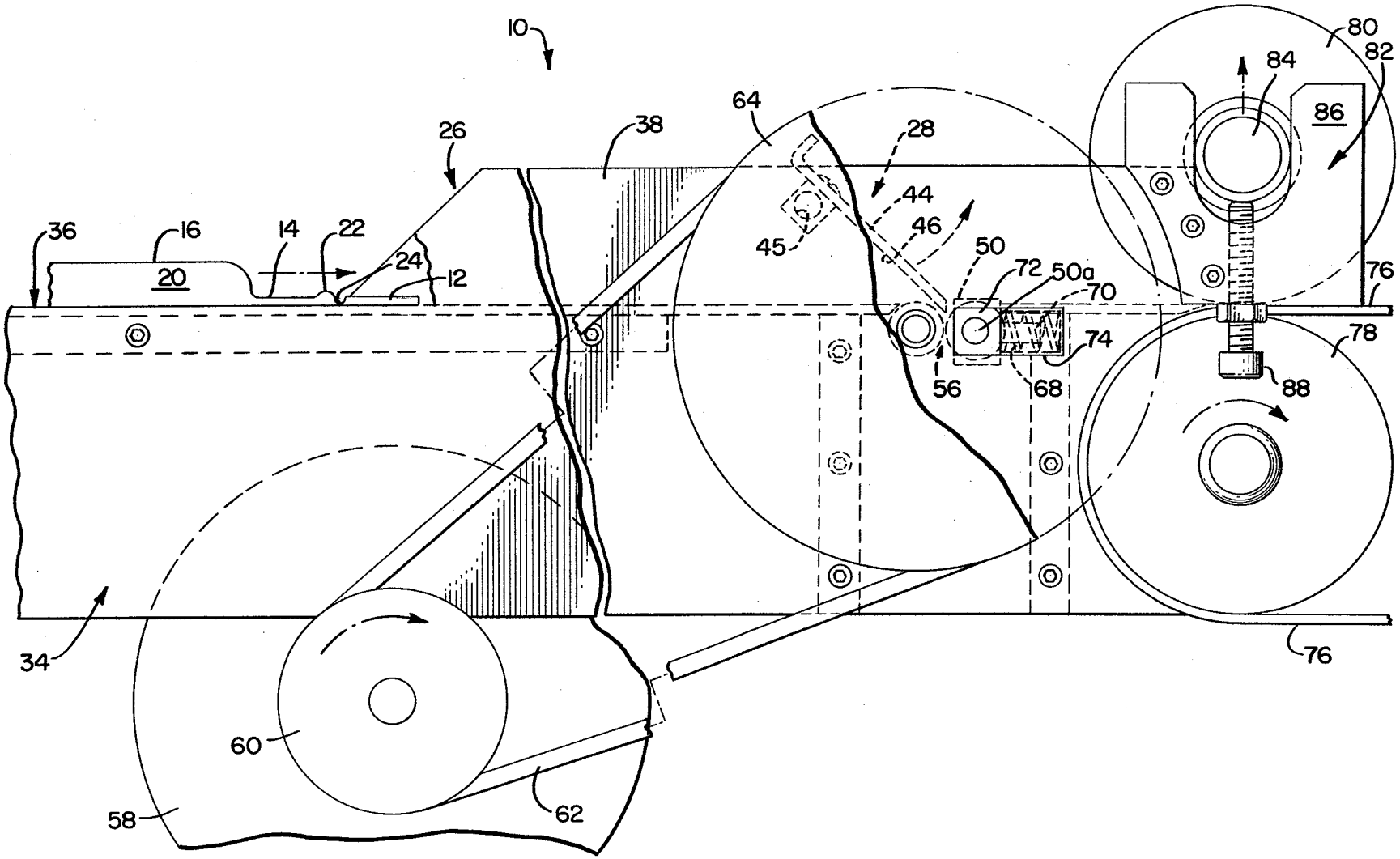
FIG. 2 is an enlarged elevational view illustrating more details of the novel and improved tear seal stripping apparatus of the present invention.

The vinyl case 16 is depicted as being comprised of a suitably encased relatively rigid body member 18 which is typically made of chipboard or other similar type of material. Such material, for successful practice of the invention, should serve to resist being pulled downwardly along with the continuous web 12, for reasons afterward made clear. Encasing the chipboard article or body member 18 is a suitable covering of vinyl material 20 which is wrapped thereabout. In standard practice, mating surfaces of overlapping vinyl layers are joined together at bead 22 (FIG. 2) by being heat sealed along the periphery of the body member 18. The non-heat sealed layers which extend beyond the bead 22 formed by the hot seal operation form the continuous web of tear seal trim material 12. Also, best shown in FIG. 2 is a fragile weakened section 24, also formed between the bead 22 and tear seal trim 12. It will be recognized, of course, that the weakened section 24, in known fashion, serves to facilitate the tearing or separation of the tear seal trim 12 in a manner to be described. It should be further pointed out, however, that although this particular embodiment is directed to the stripping of tear seal trim 12 from the heat sealed edges of a vinyl case 16, it is, of course, understood that other severable types of continuous web materials are contemplated as being able to be severed or stripped in accordance with the principles of this invention.

Described in essential aspects, the stripping apparatus 10 basically includes supporting means 26, deflecting means 28, stripping or severing means 30, and advancing means 32. As will be more completely explained, this particular arrangement enables the rapid and continuous stripping of the tear seal from the marginal edges of a wide variety of containers of different sizes and configurations.

As concerns supporting means 26, reference is initially made to FIGS. 1 and 2, wherein such is generally defined by a suitable structural frame assembly 34 that includes a suitable plurality of upright support legs (not shown) appropriately connected at their top ends to a table portion 36. The supporting means 26 is also formed with generally parallel upstanding sidewall supports 38 for purposes subsequently made evident. As best viewed in FIG. 1, the table portion 36 is defined by two generally flat coextensive plate members 40 which have a generally rectangular configuration and serve to form receiving and guiding surfaces 42. The plates 40 are positioned on opposite sides of the severing means 30. The central purpose served by the receiving surfaces 42 is to facilitate the sliding advancement of the vinyl case 16 along a predetermined generally linear path. Displacement occurs in response to an operator or other device forcing the case 14 toward the stripping means 30 in the direction of the arrows. As will be explained, the stripping means 30 will function to successfully strip the tear seal trim 12 generally along the weakened portion 24 extending outwardly from the bead 22.

Figure 3:
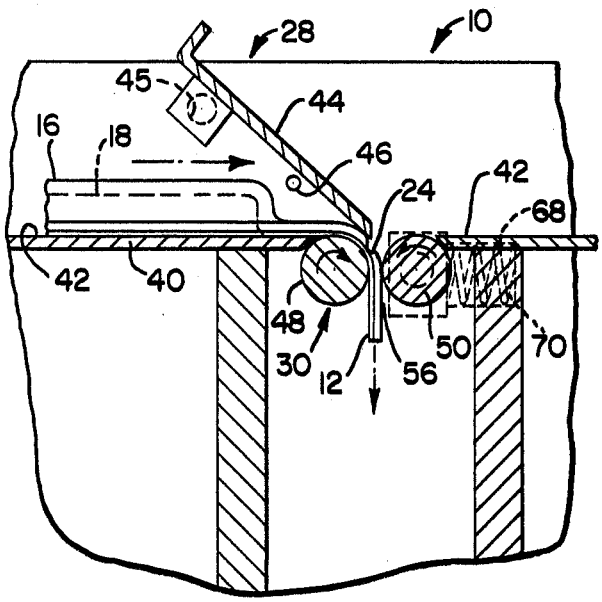
FIG. 3 represents an enlarged sectional view more clearly illustrating the separating rollers of the present invention effecting separation of the tear seal trim from the margin of a vinyl case to which the tear seal trim is connected as the vinyl case is advanced along a predetermined path.
Figure 4:
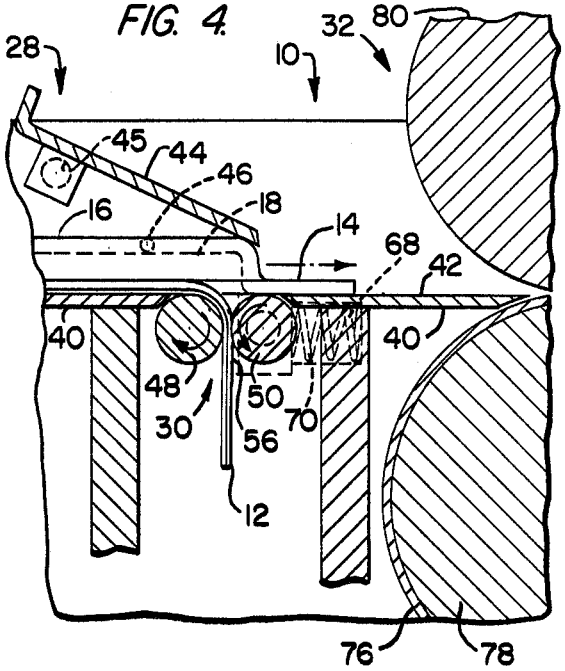
FIG. 4 represents an enlarged view similar to FIG. 3, but illustrating a further sequence in the cooperation between the stripping rollers and the tear seal trim as the vinyl case is further advanced along a predetermined path.
Figure 5:
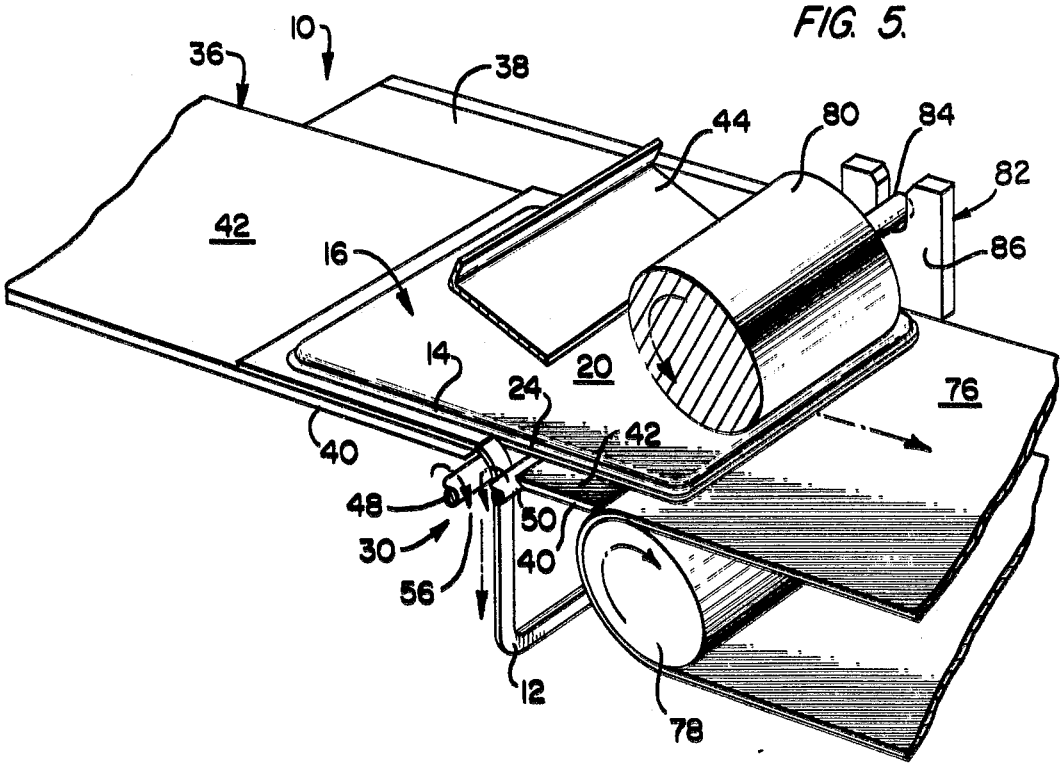
FIG. 5 represents a schematic perspective view even further illustrating the continued removal of additional tear seal trim from along the marginal edges of the vinyl case as the latter is being advanced along a predetermined path and the cooperation thereof with the separating and advancing rollers forming an aspect of the apparatus made in accordance with the principles of this invention.

Reference is now made to FIG. 3 wherein the pivoting deflecting means 28 which is operatively connected to the supporting means 26 so as to generally guide the leading edge of the tear seal 12 towards and into cooperation with the stripping means 30. In the illustrated embodiment, the pivoting deflecting means 28 is comprised of a generally flat plate member 44 pivotally connected at its opposite ends **44*a*, in a known manner, as by pins 45 with a respective supporting plate 38. Such deflecting means 28 further includes at least one stopping pin 46 which is arranged to protrude inwardly from a side plate 39. In the assembled at rest condition, the deflecting plate 44 is arranged to have its free end terminate a relatively small distance above the separating means 30. In this particular manner, the deflecting plate 44 is able to more successfully deflect the leading edge of the tear seal 12 downwardly towards the separating means. Also, as shown in FIGS. 4 and 5, the deflecting plate 44 is pivoted upwardly relative to the solid line position indicated in FIG. 3. By virtue of this particular arrangement, the vinyl case 16 is able to be force-fed through the stripping apparatus 10 along a predetermined generally horizontal path defined by the receiving surfaces 42** of the table portion.

In regard to the stripping means 30, reference is particularly made to both FIGS. 1 and 2 taken in conjunction with FIGS. 3 to 5. The central purpose served by the stripping means 30 is to tear or separate the waste tear seal trim 12 from the marginal edges 14 of the vinyl case 16 as the latter is advanced along its predetermined generally horizontal path. Essentially, the stripping means 30 includes a pair of drive and driven separating rollers 48 and 50, respectively, drive train assembly 52, and biasing means 54. Each of the pair of separating rollers 48 and 50 is a generally longitudinally extending nip roller that is placed in closely spaced apart and parallel relationship from each other. As shown in FIG. 2, the biasing means 54 generally serves to yieldedly bias the driven roller 50 into driving engagement with the driving roller 48. The separating rollers 48 and 50 may be separated to define therebetween a corresponding longitudinal nip space 56 (see FIGS. 3 to 5) which is appropriately sized to receive the marginal tear seal trim 12 and advance it along a path divergent to that taken by the vinyl case 16. The diverted and subsequently severed marginal tear seal trim 12 continues to advance to a suitable receptacle (not shown). Each separating roller 48 and 50 has corresponding end shafts 48*a* and 50*a*, respectively, journalled in the side plates 38 for rotation.

As to the train drive assembly 52, such is best shown in FIGS. 1 and 2, and such is particularly adapted to drivingly rotate the driving separating roller 48 which, in turn, suitably drives the driven roller 50. Basically, the drive train assembly 52 includes any conventional and suitable drive motor 58 which may be secured to one supporting plate 38 and functions to power a drive pulley 60. The drive pulley 60 through an endless belt 62 transfers motion to a larger pulley 64 affixed to an end of the driving shaft 48*a* extending laterally from supporting plate 38 to drive such shaft. With continued reference to FIG. 1, the drive train assembly includes a pair of driving meshing gears 66, 66*a* fastened at opposite ends of driving and driven shafts 48*a* and 50*a*, respectively so that the rotation imparted to driving gear 66 through shaft 48*a* serves the conventional purpose of driving the driven gear 66*a* and, in turn, shaft 50*a* and roller 50 in unison therewith. Such rotation is in an opposite direction to the rotation of the driving roller 48.

With respect to the biasing means 54 of this embodiment reference is made to FIG. 2. The biasing means 54 is conventional and essentially serves the purpose of yieldedly ensuring a uniformly firm engagement of the driven roller 50 with the continuously advancing tear seal trim 12 so as to tightly press the tear seal into engagement with the driving roller 50. This cooperation serves to facilitate the stripping action. Towards this particular end, the biasing means 54 comprises at each driven shaft end 50*a*, a biasing spring 68 surrounding a bearing shaft 70 connected to and biasing a bearing block 72 journalling the shaft 50*a* toward the driving roller 48. A cup-shaped housing 74 which surrounds and receives the spring is appropriately received within a corresponding cut-out formed in the side of the frame assembly 34.

Owing to the above constructional arrangement, the severing means 30 acts to sever the tear seal trim 12 by pulling it from along the marginal edge 14 of vinyl case 16. Since the edge 14 is weakened along line 24 and the vinyl case is relatively rigid, the latter will be able to travel over and past the separating rollers 48 and 50 without also being pulled downwardly along with the tear seal trim 12. This particular sequence of the stripping operation is more clearly shown in FIGS. 3 to 5. It will be apparent that the tear seal trim 12 will continuously and gradually become separated by grabbing and pulling from along the marginal edge 14 as the vinyl case 16 is continually pushed along the receiving surface 42. After the vinyl case 16 passes over the separating rollers 48 and 50 it initially slidably engages the opposite plate 40. Accordingly, it will continue to be able to be longitudinally displaced. Once the leading end of the stripped vinyl case 16 comes into operative contact with advancing means, it will be automatically longitudinally advanced as afterwards more clearly described.

With respect to the automatic advancing means 32, such is more clearly shown in FIGS. 1 and 2 taken with FIG. 5, wherein it is essentially seen to include endless conveying belt 76, cooperating driving and driven rollers 78 and 80, respectively and saddle bearing means 82. It will be appreciated that both rollers 78 and 80 together with the conveying belt 76 will serve to automatically advance the vinyl case so as to continue and complete the stripping action. The belt 76 cooperates, in standard fashion, with the driving roller 78 and is to be advanced in the direction of rotation of the latter as indicated by the arrows in FIGS. 2 and 5. The driven roller 80 cooperates with the belt 76 and driving 78 roller, in known fashion, so as to be driven in an opposite direction or rotation, by virtue of this particular arrangement. Since the driven roller 80 has its shaft ends 84 cooperating in a known manner, with the saddle bearings means 82 the driven roller 80 is able to be vertically lifted in response to contact with the passing vinyl case 16. In other words, the driven roller 80 will rise in response to engagement and continued travel of the case 16. Also, the driven roller 80 will through gravity, remain in contact with the top of the case 16 and serve to exert a downward pressure on the advancing case to ensure contact of the latter with the driven conveying belt 76. As a consequence thereof, the case 16 is able to be continuously moved along in an automatic fashion. Each end of the driven shaft 84 rests and cooperates with the saddle bearing means 82.

The saddle bearing means 82 is of a standard type that includes a generally U-shaped support member 86 that is fastened to the side wall 38 of the table 36 so as to support the shaft ends 84 of the driven roller 80. A threaded adjusting bolt 88 extends upwardly and protrudes into the U-shaped space such as depicted best in FIG. 2. The driven shaft 84 is adapted to rotatably rest upon bolt 88 as well as rotate within support member 86. By this arrangement, the driven roller 80 can be adjustably raised with respect to the conveying belt 76. Therefore, the height of the driven roller 80 above the conveying belt 76 can appropriately be selected to facilitate passage of vinyl case 16 or other items. Accordingly, the driven roller 80 may be vertically raised or lowered so to permit passage of cases 16 having different height dimensions. As noted, such roller 80 will rest on the advancing case 16 so as to ensure the fact that the latter will contact and be advanced by the conveying belt 76. After describing the constructional organization of components of the advancing means 32, its operation is believed self-evident. Accordingly, the advancing means 32 serves to automatically advance the vinyl case 16 or other package as it comes between the belt 76 and driven roller 80. Consequently, the operator who had been forcing the case 16 through need not continue to push any longer, since the advancing means 32 will serve to continue the longitudinal displacement of the case 16.

In the usual operation of the stripping apparatus 10 it will function in the following manner. An operator will place a vinyl case 16 still having the waste marginal trim 12 onto the receiving surface 42, such as shown in FIG. 2. Thereafter, the vinyl case 16 is displaced in the direction of the deflecting plate 44 whereupon the leading edge of the trim seal 12 makes contact with such deflecting plate. The plate 44 generally functions to force the advancing part of the trim seal 12 downwardly towards the pair of separating rollers 48 and 50. The separating rollers 48 and 50 basically serve to pull the trim seal 12 downwardly. However, the rigid chipboard body 18 of the vinyl case 16 resists being pulled downwardly by the rollers. Accordingly, the dual action of the separating rollers 48 and 50 coupled with the continuing advancement of the case 16 enables the tear trim seal 12 to be separated from along the weakened edge 24 on the marginal edge 14. Continued advancement of the case 16 will not only result in corresponding separation but will result in its forward portion coming into contact with the conveying belt 76 and driven roller 80. In this fashion the roller 80 will rise and the belt 76 and roller 80 will cooperate to automatically linearly pull the case 16 along the predetermined path by the conveying belt 76. Since the advancing means 32 accomplishes this automatic continuing displacement of the stripping case, the noted action on the trim seal 12 correspondingly continues. Consequently, an operator need only force the vinyl case in one direction in order to ensure complete separation of the marginal edge from the peripheral contours of the case 16 until the advancing means 32 automatically takes over to complete the stripping. Of course, such an operation significantly expedites the overall stripping operation since the operator need not be occupied with the entire separating action. As a result of the foregoing, it is evident that the apparatus and method of the present invention serves to strip vinyl cases of the severable waste material in a manner which is simple, reliable, efficient and economical.

While the invention has been described in connection with the preferred embodiments, it is not intended to limit the invention to the particular forms set forth above, but, on the contrary, it is intended to cover such alternatives, modifications, and equivalents as may be included within the spirit and scope of the invention as defined by the appended claims.

What is claimed is:

1. An apparatus for use in stripping a continuous web of severable material from at least along a portion of the marginal edge of a body comprising supporting means having a receiving surface upon which the body with the continuous web is advanced along a predetermined path, deflecting means pivotally connected to the supporting means for assisting in directing the leading edge of the advanced continuous web vertically so as to facilitate a stripping thereof while permitting travel of the body along the path, stripping means including a pair of generally longitudinal and cooperating rollers are connected to the supporting means and positioned along the path for grabbing therebetween the vertically deflected continuous web and stripping it from the body in response to the advancement of the body along the path, and advancing means operatively connected to the supporting means remote from the stripping means for automatically continuing the advancement of the body by pulling the body past said rollers along the path for ensuring complete tearing apart of the web from the marginal edge, said advancing means including roller means automatically vertically movable for accommodating bodies of varying thickness, and said deflecting means being comprised of an inclined and pivotally mounted plate having its free end terminate above said stripping means by a distance which serves to have such plate guide the advancing web towards and into engagement with said stripping means while permitting bodies of varying thickness to move therepast.

2. The apparatus set forth in claim 1 in which said advancing means includes a driven conveying belt, said roller means cooperating with said belt to be driven thereby, and saddle bearing means being operatively connected to said supporting means, said driven roller operatively cooperating with said bearing means so as to be vertically movable in response to passage between it and said conveying belt of the body for automatically advancing the body along the conveying belt.

3. An apparatus for use in stripping a continuous web of severable material from at least along a portion of the marginal edge of a body comprising supporting means having a receiving surface upon which the body with the continuous web is advanced along a predetermined path, deflecting means pivotally connected to the supporting means for assisting in directing the leading edge of the advanced continuous web vertically so as to facilitate a stripping thereof while permitting travel of the body along the path, stripping means including a pair of generally longitudinal and cooperating rollers are connected to the supporting means and positioned along the path for grabbing therebetween the vertically deflected continuous web and stripping it from the body in response to the advancement of the body along the path, and advancing means operatively connected to the supporting means remote from the stripping means for automatically continuing the advancement of the body by pulling the body past said rollers along the path for ensuring complete tearing apart of the web from the marginal edge, said deflecting means is comprised of an inclined and pivotally mounted plate having its free end terminate above said stripping means by a distance which serves to have such plate guide the advancing web towards and into engagement with said stripping means while permitting the body to move therepast, said advancing means includes a driven conveying belt, a roller means cooperating with said belt to be driven thereby, and saddle bearing means being operatively connected to said supporting means, said driven roller operatively cooperating with said bearing means so as to be vertically movable in response to passage between it and said conveying belt of the body for automatically advancing the body along the conveying belt.

* * * * *

UNITED STATES PATENT AND TRADEMARK OFFICE

CERTIFICATE OF CORRECTION

PATENT NO. : 4,096,981

DATED : June 27, 1978

INVENTOR(S) : Sam Martorano

It is certified that error appears in the above-identified patent and that said Letters Patent are hereby corrected as shown below:

Column 1, line 58, "2,798,640" should read --2,789,640--

Column 5, line 3, "train drive" should read --drive train--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*